US006900422B2

(12) United States Patent
Herold et al.

(10) Patent No.: US 6,900,422 B2
(45) Date of Patent: May 31, 2005

(54) MICROWAVE DEVICE

(75) Inventors: Bernhard Herold, Regensburg (DE); Katrin Horn, Traunreut (DE); Kurt Lintner, Nussdorf (DE); Martin Schulte, Hagen (DE); Martin Thaler, Oberteisendorf (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/402,815

(22) Filed: Mar. 28, 2003

(65) Prior Publication Data

US 2004/0020920 A1 Feb. 5, 2004

Related U.S. Application Data

(63) Continuation of application No. PCT/EP01/10959, filed on Sep. 21, 2001.

(30) Foreign Application Priority Data

Sep. 28, 2000 (DE) ..... 100 48 158

(51) Int. Cl.[7] ..... H05B 6/76
(52) U.S. Cl. ..... 219/685; 219/738; 174/35 R
(58) Field of Search ..... 219/685, 736, 219/738, 740, 758; 392/408, 422; 174/35 R, 35 MS

(56) References Cited

U.S. PATENT DOCUMENTS

| | | | | |
|---|---|---|---|---|
| 3,878,350 A | * | 4/1975 | Takagi | 219/685 |
| 4,896,656 A | * | 1/1990 | Johnson | 126/92 B |
| 6,153,867 A | | 11/2000 | Lee | |

FOREIGN PATENT DOCUMENTS

| | | |
|---|---|---|
| DE | 36 12 681 A1 | 7/1987 |
| DE | 39 07 248 A1 | 9/1990 |
| DE | 39 31 859 A1 | 4/1991 |
| DE | 40 12 333 C1 | 6/1991 |
| DE | 40 35 177 A1 | 5/1992 |
| DE | 43 22 946 A1 | 1/1995 |
| EP | 0 976 975 A2 | 2/2000 |
| EP | 1 005 255 A1 | 5/2000 |
| WO | 98/34436 | 8/1998 |

* cited by examiner

*Primary Examiner*—Philip H. Leung
(74) *Attorney, Agent, or Firm*—John T. Winburn; Russell W. Warnock; Craig J. Loest

(57) ABSTRACT

A microwave device includes a cooking space disposed in a housing, at least one microwave source, and at least one further radiation source, as an alternative to the microwave source, which is protected from microwaves from the microwave source by a shielding grid. At least one grid wall of the shielding grid has a radiation reflector by which it is possible for rays from the alternative radiation source to be reflected into the cooking space.

26 Claims, 4 Drawing Sheets

MICROWAVE DEVICE

CROSS-REFERENCE TO RELATED APPLICATION

This application is a continuation of copending International Application No. PCT/EP01/10959, filed Sep. 21, 2001, which designated the United States and was not published in English.

BACKGROUND OF THE INVENTION

FIELD OF THE INVENTION

The invention relates to a microwave device having a housing defining a cooking space, at least one microwave source, and at least one further radiation source.

European Patent Application 1 005 255 A1, corresponding to U.S. Pat. No. 6,153,867 to Lee, discloses a generically determinative microwave device. The microwave device has a cooking space disposed in a housing, a microwave source, and a halogen lamp. The halogen lamp may be used as a heating element. To protect the halogen lamp, in particular, an incandescent filament of the halogen lamp, from microwaves from the microwave source, and to keep a leakage rate over power supply lines to the halogen lamp below defined limit values, a grating made of an electrically conductive material is disposed in front of the halogen lamp. A sheet metal plate provided with cutouts forms the grating.

SUMMARY OF THE INVENTION

It is accordingly an object of the invention to provide a microwave device that overcomes the hereinaforementioned disadvantages of the heretofore-known devices of this general type and that increases efficiency in a microwave device.

With the foregoing and other objects in view, there is provided, in accordance with the invention, a microwave device, including a housing defining a cooking space therein, at least one microwave source supplying microwaves to the cooking space, at least one further radiation source supplying rays to the cooking space, and a shielding grid protecting the at least one further radiation source from the microwaves, the shielding grid having at least one grid wall with a radiation reflector reflecting the rays from the at least one further radiation source into the cooking space.

With the objects of the invention in view, there is also provided a microwave device, including a housing defining a cooking space therein, at least one microwave source supplying microwaves to the cooking space, at least one alternative radiation source supplying rays to the cooking space as an alternative to the at least one microwave source, and a shielding grid protecting the at least one alternative radiation source from the microwaves, the shielding grid having at least one grid wall with a radiation reflector reflecting the rays from the at least one alternative radiation source into the cooking space.

The invention is based on a microwave device having a cooking space disposed in a housing, at least one microwave source, and at least one further radiation source, as an alternative to the microwave source, which is protected from microwaves from the microwave source by a shielding grid.

In accordance with another feature of the invention, at least one and, advantageously, all of the grid walls of the shielding grid each have a radiation reflector by which it is possible for rays from the alternative radiation source to be reflected into the cooking space. When shielding the radiation source from microwaves in an advantageous manner it is possible, at the same time, to avoid, at least to a large extent, the rays from the alternative radiation source being absorbed, and to increase efficiency.

The solution according to the invention may be implemented using various radiation sources, as deemed appropriate by the person skilled in the art, for example, in the case of radiation sources, which emit pure thermal radiation etc.

However, in accordance with a further feature of the invention, the solution according to the invention is particularly advantageously implemented when using radiation sources formed by light sources and having a filament. Light sources having a filament, in particular, require shielding, specifically, to protect the filament from damage and, at least to a large extent, to avoid leakage of microwaves over the filament and over supply lines to the filament. Furthermore, in accordance with an added feature of the invention, uniform illumination of the cooking space may be achieved by using the shielding grid according to the invention. The light source may emit purely visible light to illuminate the cooking space or may, advantageously, also be configured to be used as a heating element, specifically, by it emitting, for example, light in the infrared range, as is the case, in particular, with halogen lamps. By using the shielding grid according to the invention, it is possible for the light source to attain an advantageous heating efficiency.

The reflector may be formed by a planar surface that is formed perpendicular to a bearing surface in the cooking space. However, to avoid any multiple reflections that may occur or any associated losses, in accordance with an additional feature of the invention, one or more reflectors may, advantageously, be inclined toward the cooking space and/or may be bent so that the rays are reflected advantageously into the cooking space.

In accordance with yet another feature of the invention, at least one and, advantageously, all of the grid walls are formed by a thin-walled, polished metal, by which it is possible to obtain a cost-effective shielding grid having, preferably, small wall thicknesses. In addition, it is, however, also possible for the walls to be coated with a highly reflective material, such as, for example, with aluminum, silver, etc., by which it is possible for high reflection rates and low absorption values to be obtained.

In accordance with yet a further feature of the invention, the grid wall has a thickness of between approximately 0.1 mm and approximately 5 mm, in particular, approximately 0.2 mm.

The shielding grid may have grid cutouts with various base surfaces, as deemed appropriate by the person skilled in the art, for example, having round, oval, or square base surfaces. However, in accordance with yet an added feature of the invention, the shielding grid particularly advantageously has grid cutouts having rectangular base surfaces, by which it is possible for the shielding grid to be configured and produced in a simple and cost-effective manner, for example, by planar metal sheets stacked together, etc.

For the microwaves to be shielded or attenuated as advantageously as possible, the shielding grid should be dimensioned such that the microwaves are, at least to a large extent, prevented from being propagated through the shielding grid. This is advantageously achieved in the case of rectangular grid cutouts by configuring the cutouts with a length smaller than half a microwave length. In addition the width of the grid cutout is configured advantageously to be equal to half the length of the grid cutout. Grid cutouts having round, oval, triangular, or pentagonal base surfaces etc. should be configured according to generally known standards so that the microwaves are, at least to a large extent, prevented from being propagated by the shielding grid.

Various attenuations result as a function of the height of the shielding grid. The height should advantageously be chosen such that at least an attenuation of 40 dB is achieved, resulting in a logarithmized ratio of 40 dB between a microwave power present upstream of the shielding grid and a microwave power present downstream of the shielding grid on the side facing the radiation source. In the case of current microwave frequencies and, in particular, in the case of a frequency of 2.45 GHz, in accordance with a concomitant feature of the invention, the shielding grid is configured, advantageously, to be between 5 mm and 50 mm in height.

Other features that are considered as characteristic for the invention are set forth in the appended claims.

Although the invention is illustrated and described herein as embodied in a microwave device, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
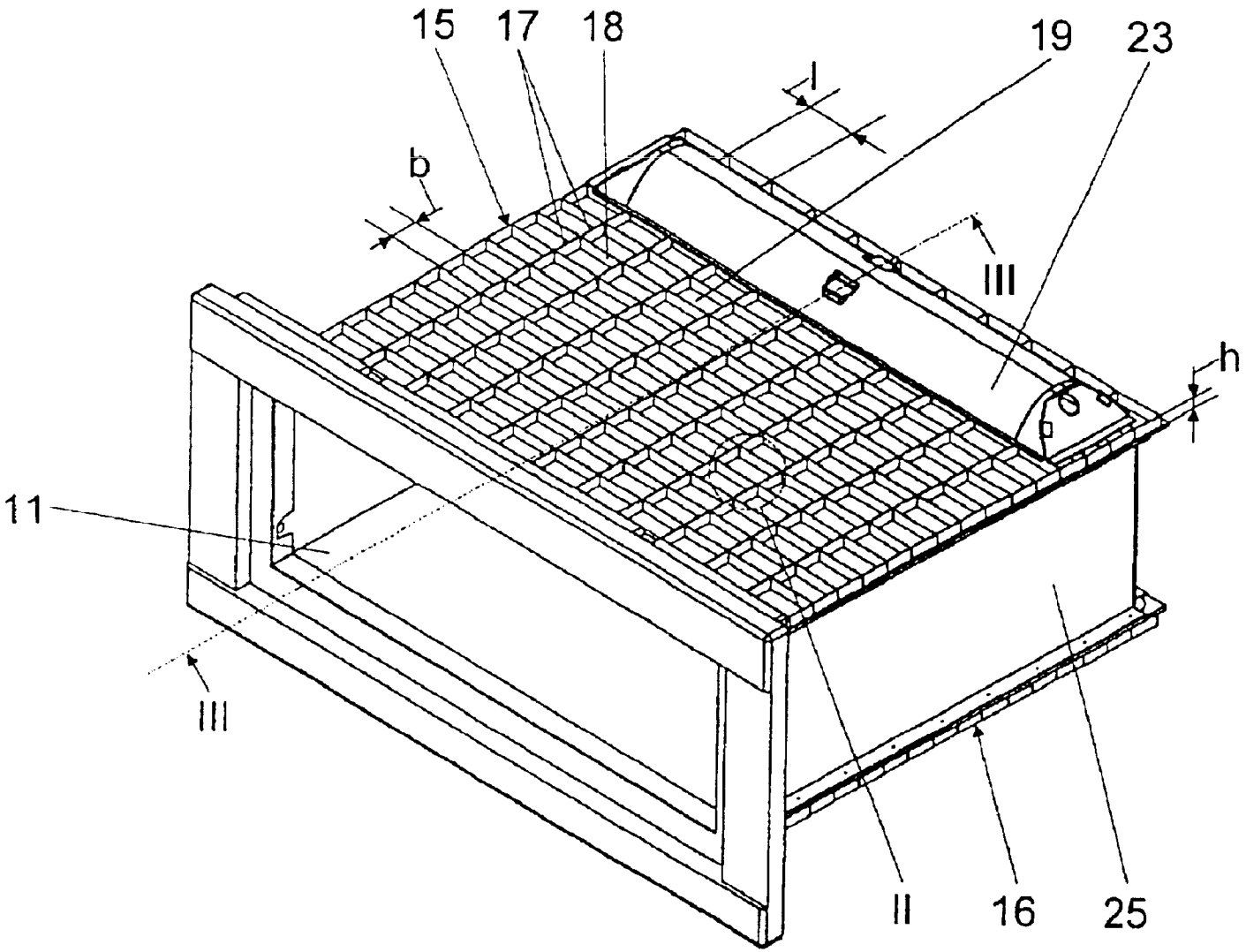
FIG. 1 is a perspective view from above a microwave device according to the invention without a housing.
Figure 3:
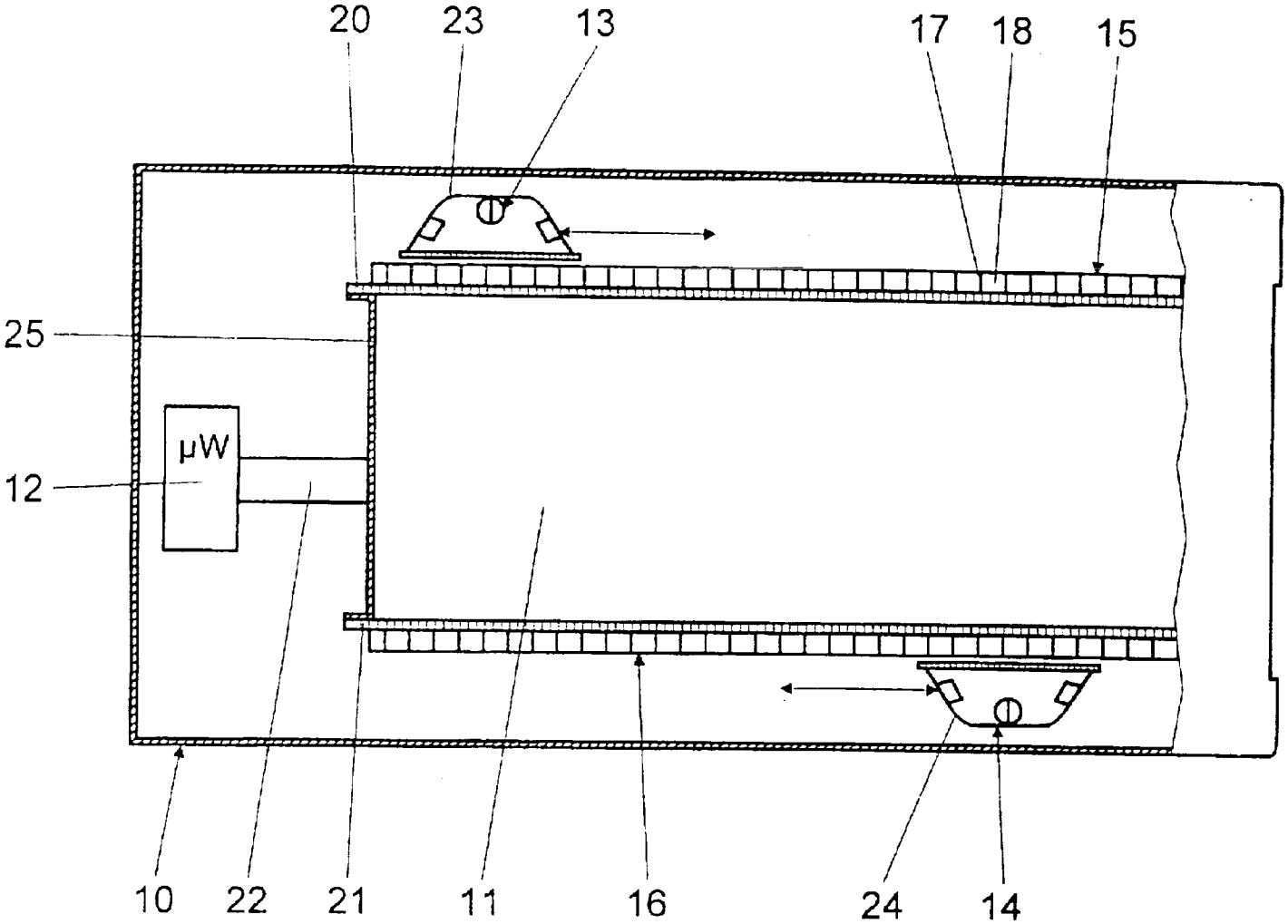
FIG. 3 is a fragmentary, cross-sectional view of the device of FIG. 1 along section line III—III.

Referring now to the figures of the drawings in detail and first, particularly to FIGS. 1 and 3 thereof, there is shown a microwave device having a cooking space 11 disposed in a housing 10, the side walls of which are formed by sheet metal walls 25 and the ceiling and floor of which are formed by glass plates 20, 21, and which may be closed at its front side by a non-illustrated door. The microwave device also has a microwave source 12 that is formed by a magnetron or a velocity-modulated tube and from which microwaves can be conducted through a waveguide 22 into the cooking space 11 to heat an item to be cooked. In addition to the microwave source 12, the microwave device has two radiation sources 13, 14 that are formed by halogen lamps. The first radiation source 13 is disposed above the glass plate 20, forming the ceiling of the cooking space 11, and the second radiation source 14 is disposed below the glass plate 21, forming the floor of the cooking space 11, and they extend transversely over the entire width of the cooking space 11. The halogen lamps that form the radiation sources 13, 14 have in each case an incandescent filament by which it is possible to generate invisible light in the infrared range to heat an item to be cooked, and visible light to illuminate the cooking space 11. To deflect light radiating in the direction averted from the cooking space 11 into the cooking space 11, the halogen lamps 13, 14 are surrounded by shell-shaped reflectors 23, 24 on a side remote from the cooking space 11. When the microwave device is operating using the halogen lamps, the lamps are moved back and forth in opposite directions above or below the cooking space 11 by a non-illustrated drive unit.

The radiation sources 13, 14 are protected from the microwaves from the microwave source 12 by shielding grids 15, 16. The first shielding grid 15 is disposed above the glass plate 20, forming the ceiling of the cooking space 11, between the glass plate 20 and the first, upper radiation source 13 and extends over the entire cooking space 11. The second shielding grid 16 is disposed below the glass plate 21, forming the floor of the cooking space 11, between the glass plate 21 and the second, lower radiation source 14 and, likewise, extends over the entire cooking space 11.

Figure 2:
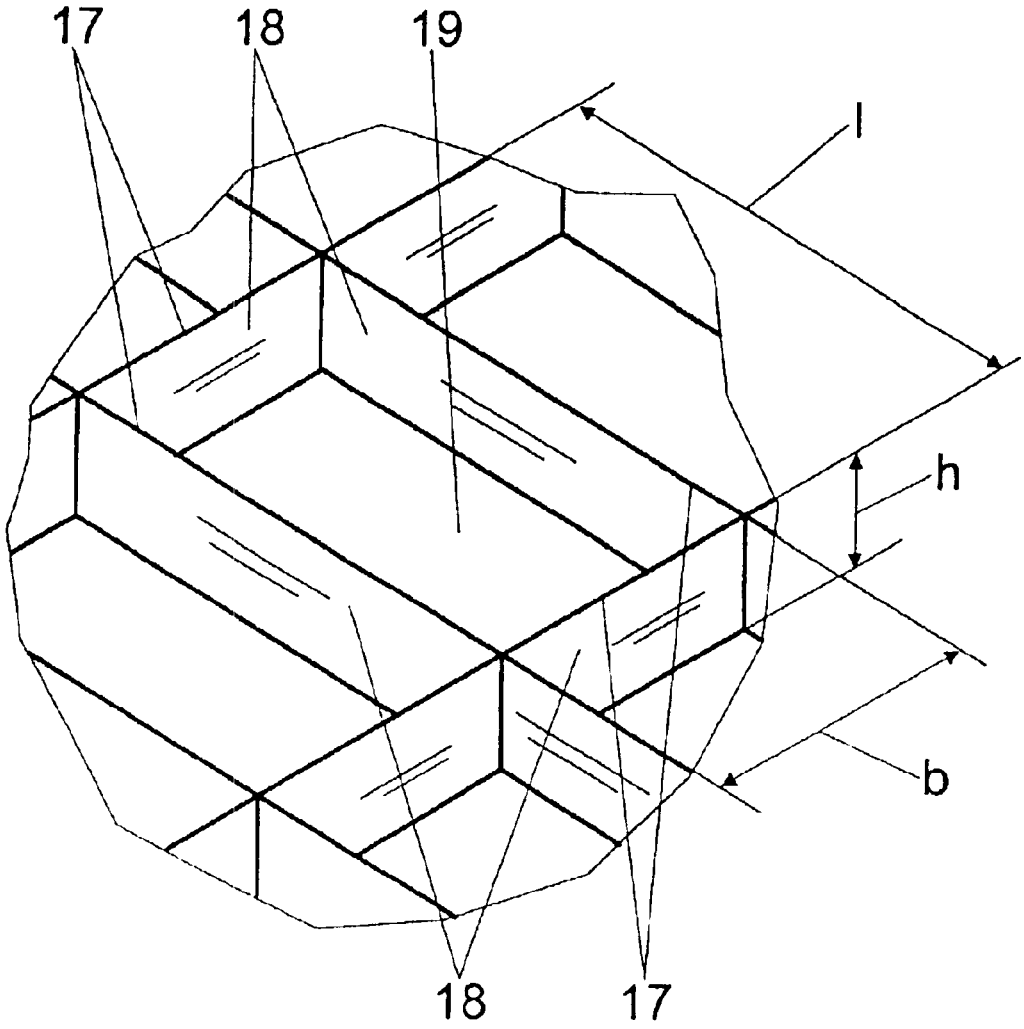
FIG. 2 is a fragmentary, perspective view of an enlarged portion of detail II of FIG. 1.

According to the invention, the grid walls 17 are formed of thin-walled, polished planar aluminum metal sheets that are aligned perpendicular to the floor and to the ceiling of the cooking space 11 such that the grid walls 17 form radiation reflectors 18 by which it is possible for rays from the radiation sources 13, 14 to be reflected into the cooking space 11. The aluminum metal sheets are stacked together and have a thickness of 0.2 mm. Other thicknesses, as deemed appropriate by the person skilled in the art, may also be conceivable, in principle, such as, for example, between 0.1 mm and 5 mm, the thinner the walls, the lesser being the extent to which rays from the radiation sources are reflected in undesirable directions at end faces of the walls. The shielding grids 15, 16 have grid cutouts 19 having rectangular base surfaces having a length 1 that is less than half a microwave length. At a prevailing microwave frequency of 2.45 GHz the length 1 should, therefore, be configured at less than 61.25 mm. In the exemplary embodiment illustrated, the length 1 of the base surface is 20 mm and the width b of the base surface is equal to half the length 1 and, therefore, 10 mm (FIGS. 1 and 2).

Figure 4:
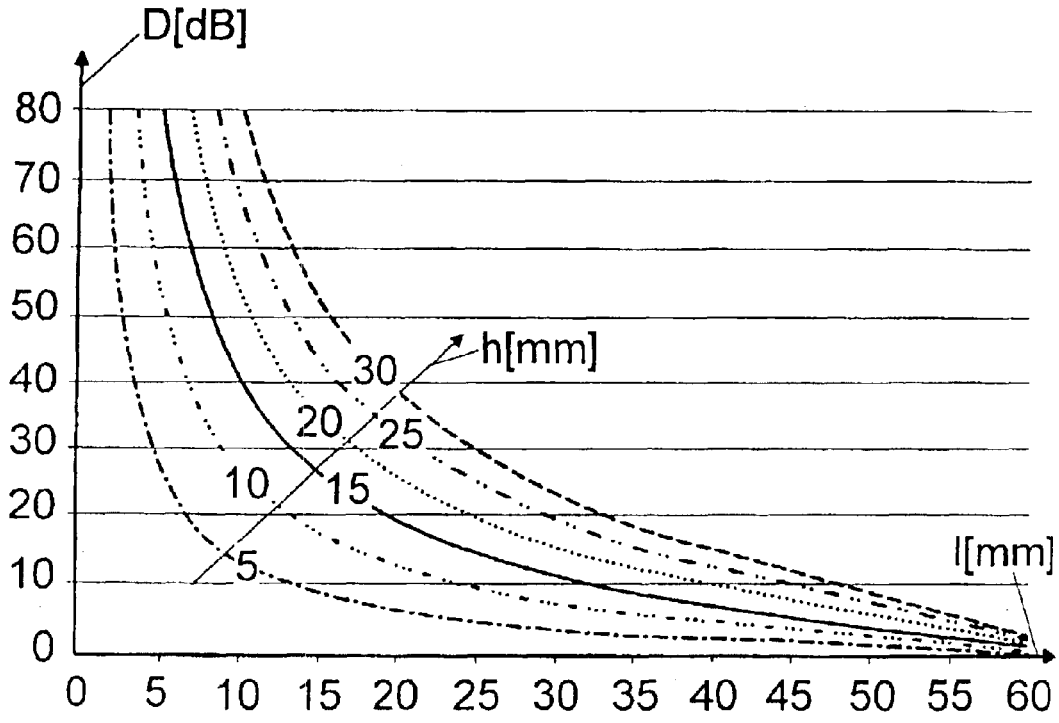
FIG. 4 is a graph illustrating microwave attenuations, as a function of height and of length of grid cutouts of various shielding grids according to the invention.

Various attentuations D result as a function of the height h of the shielding grid 15, 16, as is illustrated in FIG. 4 at a microwave frequency of 2.45 GHz. An attenuation D of greater than or equal to 40 dB should, preferably, be achieved. In the case of the exemplary embodiment illustrated, the shielding grids 15, 16 are configured to have a height h of 40 mm.

We claim:

1. A microwave device, comprising:

a housing defining a cooking space therein;

at least one microwave source supplying microwaves to said cooking space;

at least one further radiation source supplying rays to said cooking space; and a shielding grid protecting said at least one further radiation source from the microwaves, said shielding grid having at least one grid wall being a radiation reflector reflecting the rays from said at least one further radiation source into said cooking space.

2. The microwave device according to claim 1, wherein said at least one further radiation source is a light source having a filament.

3. The microwave device according to claim 2, wherein said at lease one further radiation source is a heating element.

4. The microwave device according to claim 1, further comprising at lease one reflector inclined toward said cooking space.

5. The microwave device according to claim 1, wherein said at least one grid wall is a thin-walled, polished metal.

6. The microwave device according to claim 1, wherein said at least one grid wall is a polished metal having a thickness of between approximately 0.1 mm and approximately 5 mm.

7. The microwave device according to claim 1, wherein said at least one grid wall is a polished metal having a thickness of approximately 0.2 mm.

8. The microwave device according to claim 1, wherein said shielding grid has grid cutouts with rectangular base surfaces.

9. The microwave device according to claim 8, wherein said grid cutouts have a length smaller than half a length of the microwaves.

10. The microwave device according to claim 9, wherein said grid cutouts have a width equal to half said length of said grid cutouts.

11. The microwave device according to claim 8, wherein each of said grid cutouts has a length smaller than half a length of the microwaves.

12. The microwave device according to claim 11, wherein each of said grid cutouts has a width equal to half said length.

13. A microwave device, comprising:

a housing defining a cooking space therein;

at least one microwave source supplying microwaves to said cooking space;

at least one further radiation source supplying rays to said cooking space; and a shielding grid protecting said at least one further radiation source from the microwaves, said shielding grid having at least one grid wall being a radiation reflector reflecting the rays from said at least one further radiation source into said cooking space, and said shielding grid having a height of between approximately 5 mm and approximately 50 mm.

14. A microwave device, comprising:

a housing defining a cooking apace therein;

at least one microwave source supplying microwaves to said cooking space;

at least one alternative radiation source supplying rays to said cooking space as an alternative to said at least one microwave source; and a shielding grid protecting said at least one alternative radiation source from the microwaves, said shielding grid having at least one grid wall being a radiation reflector reflecting the rays from said at least one alternative radiation source into said cooking space.

15. The microwave device according to claim 14, wherein said at least one alternative radiation source having a filament.

16. The microwave device according to claim 15, wherein said at least one alternative radiation source is a heating element.

17. The microwave device according to claim 14, further comprising at least one reflector inclined toward said cooking space.

18. The microwave device according to claim 14, wherein said at least one grid wall is a thin-walled, polished metal.

19. The microwave device according to claim 14, wherein said at least one grid wall is a polished metal having a thickness of between approximately 0.1 mm and approximately 5 mm.

20. The microwave device according to claim 14, wherein said at least one grid wall is a polished metal having a thickness of approximately 0.2 mm.

21. The microwave device according to claim 14, wherein said shielding grid has grid cutouts with rectangular base surfaces.

22. The microwave device according to claim 21, wherein said grid cutouts have a length smaller than half a length of the microwaves.

23. The microwave device according to claim 22, wherein said grid cutouts have a width equal to half said length of said grid cutouts.

24. The microwave device according to claim 21, wherein each of said grid cutouts has a length smaller than hale a length of the microwaves.

25. The microwave device according to claim 24, wherein each of said grid cutouts has a width equal to half said length.

26. The microwave device according to claim 14, wherein said shielding grid has a height of between approximately 5 mm and approximately 50 mm.

* * * * *